US007971563B2

(12) United States Patent
Sato et al.

(10) Patent No.: US 7,971,563 B2
(45) Date of Patent: Jul. 5, 2011

(54) ENGINE VALVE OPERATING SYSTEM

(75) Inventors: Yoshikazu Sato, Wako (JP); Noboru Kawaguchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 280 days.

(21) Appl. No.: 11/921,078

(22) PCT Filed: Jun. 20, 2006

(86) PCT No.: PCT/JP2006/312285

§ 371 (c)(1),
(2), (4) Date: Jul. 28, 2009

(87) PCT Pub. No.: WO2006/137378

PCT Pub. Date: Dec. 28, 2006

(65) Prior Publication Data

US 2010/0064995 A1 Mar. 18, 2010

(30) Foreign Application Priority Data

Jun. 23, 2005 (JP) ..... 2005-183604

(51) Int. Cl.
*F01M 1/06* (2006.01)

(52) U.S. Cl. ..... 123/90.33; 123/90.34; 123/193.3; 123/198 P

(58) Field of Classification Search ..... 123/90.15, 123/90.16, 90.17, 90.18, 193.3, 193.5, 198 F, 123/198 P, 90.33, 90.34, 90.38; 464/1, 2, 464/160

See application file for complete search history.

(56) References Cited

U.S. PATENT DOCUMENTS 6,484,679 B2 * 11/2002 Ito et al. ..... 123/90.31
6,508,224 B2 1/2003 Ito et al.

FOREIGN PATENT DOCUMENTS

CN 1313456 A 9/2001
JP 61-182406 A 8/1986
JP 1-13919 A 4/1989

(Continued)

*Primary Examiner* — Ching Chang
(74) *Attorney, Agent, or Firm* — Arent Fox LLP

(57) ABSTRACT

In an engine valve operating system, a timing transmission chamber (48) is formed on one side of an engine main body; the timing transmission chamber (48) houses a timing transmission system (37) that provides a connection between a crankshaft (12) and a camshaft (36) disposed above intake and exhaust valves (29*i*, 29*e*); opposite end parts of the camshaft (36) are supported by one side wall (5*a*) of a cylinder head (5) and a dividing wall (5*b*) that is adjacent to the timing transmission chamber (48); and a valve operating chamber (49) housing the camshaft (36) is defined between said one side wall (5*a*) and the dividing wall (5*b*). An oil slinger (72) is disposed in a lower part of the timing transmission chamber (48). An oil passage hole (75) is provided in the dividing wall (5*b*), the oil passage hole (75) guiding scattered oil that has been shaken off in an upper part of the timing transmission system (37) to the valve operating chamber (49). An oil return passage (77) is provided for transmitting pressure pulsations generated in the crank chamber (9) to the valve operating chamber (49), and making oil that has collected in the valve operating chamber (49) flow downward to the crank chamber (9) within the crankcase (2). Thus, the interiors of the timing transmission chamber and the valve operating chamber which are separated from each other can be lubricated without using an oil pump, while maintaining an arrangement in which the camshaft is disposed above the intake and exhaust valves.

4 Claims, 13 Drawing Sheets

FOREIGN PATENT DOCUMENTS

| | | | |
|---|---|---|---|
| JP | 1-316238 | A | 12/1989 |
| JP | 3-41103 | U | 4/1991 |
| JP | 7-305615 | A | 11/1995 |
| JP | 2001-59409 | A | 3/2001 |
| JP | 2002-147213 | A | 5/2002 |
| KR | 10-0376063 | B1 | 3/2003 |

* cited by examiner

ENGINE VALVE OPERATING SYSTEM

CROSS-REFERENCE TO RELATED APPLICATION

This application is a National Stage entry of International Application No. PCT/JP2006/312285, filed Jun. 20, 2006, the entire specification claims and drawings of which are incorporated herewith by reference.

TECHNICAL FIELD

The present invention relates to an improvement of an engine valve operating system in which a timing transmission chamber is formed on one side of an engine main body formed from a crankcase, a cylinder block, and a cylinder head; the timing transmission chamber houses a timing transmission system that provides a connection between a crankshaft supported on the crankcase and a camshaft supported on the cylinder head above intake and exhaust valves; opposite end parts of the camshaft are supported by one side wall of the cylinder head and a dividing wall formed in the cylinder head so as to be adjacent to the timing transmission chamber; and a valve operating chamber housing the camshaft is defined between said one side wall and the dividing wall.

BACKGROUND ART

Such an engine valve operating system is already known, as disclosed in Patent Publication 1.

Patent Publication 1: Japanese Patent Application Laid-open No. 61-182406

DISCLOSURE OF INVENTION

Problems to be Solved by the Invention

Such an engine valve operating system is advantageous in terms of improving the engine output, since the camshaft can be disposed above the intake and exhaust valves which are mounted to the cylinder head, and a valve opening force of the camshaft can be efficiently and appropriately transmitted to the intake and exhaust valves.

However, in the conventional engine in which the timing transmission chamber on one side of the engine main body and the valve operating chamber in an upper part of the cylinder head are separated by the dividing wall integral with the cylinder head: lubrication is carried out for the timing transmission system disposed in the timing transmission chamber by the transmission system scattering lubricating oil that has accumulated in the timing transmission chamber; and lubrication is carried out for the valve operating chamber, which is separated from the timing transmission chamber, by an oil pump drawing up oil that has accumulated in a crank chamber to supply the oil to the camshaft and other components in the valve operating chamber. Such use of the oil pump hinders the downsizing of the engine and the cost reduction.

The present invention has been accomplished under the above-mentioned circumstances, and it is an object thereof to provide an engine valve operating system that enables not only the interior of a timing transmission chamber but also the interior of a valve operating chamber to be lubricated without using an oil pump while maintaining an arrangement in which a camshaft is disposed above intake and exhaust valves.

Means to Solve the Problems

In order to achieve the above object, according to a first feature of the present invention, there is provided an engine valve operating system in which a timing transmission chamber is formed on one side of an engine main body formed from a crankcase, a cylinder block, and a cylinder head; the timing transmission chamber houses a timing transmission system that provides a connection between a crankshaft supported on the crankcase and a camshaft supported on the cylinder head above intake and exhaust valves; opposite end parts of the camshaft are supported by one side wall of the cylinder head and a dividing wall formed in the cylinder head so as to be adjacent to the timing transmission chamber; and a valve operating chamber housing the camshaft is defined between said one side wall and the dividing wall, characterized in that an oil slinger is disposed in the timing transmission chamber, the oil slinger scattering lubricating oil that has accumulated in a base part of the timing transmission chamber to deposit the lubricating oil on a lower part of the timing transmission system; an oil passage hole is provided in the dividing wall, the oil passage hole guiding scattered oil that has been shaken off in an upper part of the timing transmission system to the valve operating chamber; and an oil return passage is provided in the cylinder head and the cylinder block, the oil return passage transmitting pressure pulsations generated in the crank chamber within the crankcase to the valve operating chamber and making oil that has collected in the valve operating chamber flow downward to the crank chamber.

According to a second feature of the present invention, in addition to the first feature, an access window opens on another side face of the cylinder head, the access window enabling a rotationally driven member of the timing transmission system to be mounted on and demounted from the camshaft; a side wall of a lid body closing the access window is inclined relative to a side face of the rotationally driven member so that scattered oil shaken off in the upper part of the timing transmission system bounces back on an inner face of the side wall of the lid body toward the rotationally driven member side; and a through hole allowing the bounced-back oil to pass therethrough is provided in the rotationally driven member.

According to a third feature of the present invention, in addition to the second feature, an oil passage channel is provided in the dividing wall, the oil passage channel providing communication between the timing transmission chamber and the valve operating chamber and around a bearing of the camshaft.

According to a fourth feature of the present invention, in addition to any one of the first to third features, a one-way valve is provided in the oil passage hole, the one-way valve allowing only negative pressure to be transmitted from the valve operating chamber to the timing transmission chamber.

The rotationally driven member corresponds to a driven pulley 46 of embodiments of the present invention, which will be described later.

Effects of the Invention

In accordance with the first feature of the present invention, an oil mist is formed in the timing transmission chamber by the operation of the oil slinger and the timing belt, whereas the pressure pulsations generated in the crank chamber are transmitted to the valve operating chamber through the oil return passage. As a result, the oil mist not only lubricates the timing transmission system, but also moves to and fro between the timing transmission chamber and the valve operating chamber via the oil passage hole of the dividing wall by virtue of the effect of the above-mentioned pressure pulsations. Therefore, also the valve operating mechanism section including the camshaft within the valve operating chamber can be lubricated, and the oil that has completed lubrication can return to the crank chamber via the oil return passage.

In this way, by utilizing the operation of the oil slinger and the timing transmission system as well as the pressure pulsations of the crank chamber, the interiors of the timing transmission chamber and the valve operating chamber, which are separated from each other, can be lubricated with the oil mist. Thus, it is unnecessary to employ an oil pump exclusively used for lubrication, whereby the structure of the engine E can be simplified and made compact, and the cost can be reduced.

Further, since the conventional arrangement in which the camshaft is disposed above the intake and exhaust valves can be maintained, it is possible to ensure a desired output performance for the engine.

In accordance with the second feature of the present invention, part of the scattered oil that has bounced back on the lid body of the access window travels toward the rotationally driven member side, passes through the through hole of the rotationally driven member, and reaches the bearing of the camshaft facing the timing transmission chamber, thereby excellently lubricating the bearing. Further, by removing the lid body, the rotationally driven member of the timing transmission system can be mounted on and demounted from the camshaft through the access window, thus improving the ease of maintenance.

In accordance with the third feature of the present invention, part of the oil that has reached the bearing moves to the valve operating chamber through the oil passage channel on the outer periphery of the bearing, thereby lubricating the bearing also from the valve operating chamber side. Thus, the bearing is lubricated from opposite side faces, thus providing remarkably excellent lubrication.

In accordance with the fourth aspect of the present invention, when the pressure pulsations generated in the crank chamber reach the valve operating chamber, only the negative pressure thereof passes through the one-way valve and acts on the timing transmission chamber. Therefore, oil mist in the timing transmission chamber can be drawn efficiently into the valve operating chamber by virtue of the action of the negative pressure, thus enhancing the lubrication within the valve operating chamber.

EXPLANATION OF REFERENCE NUMERALS AND SYMBOLS

Figure 1:
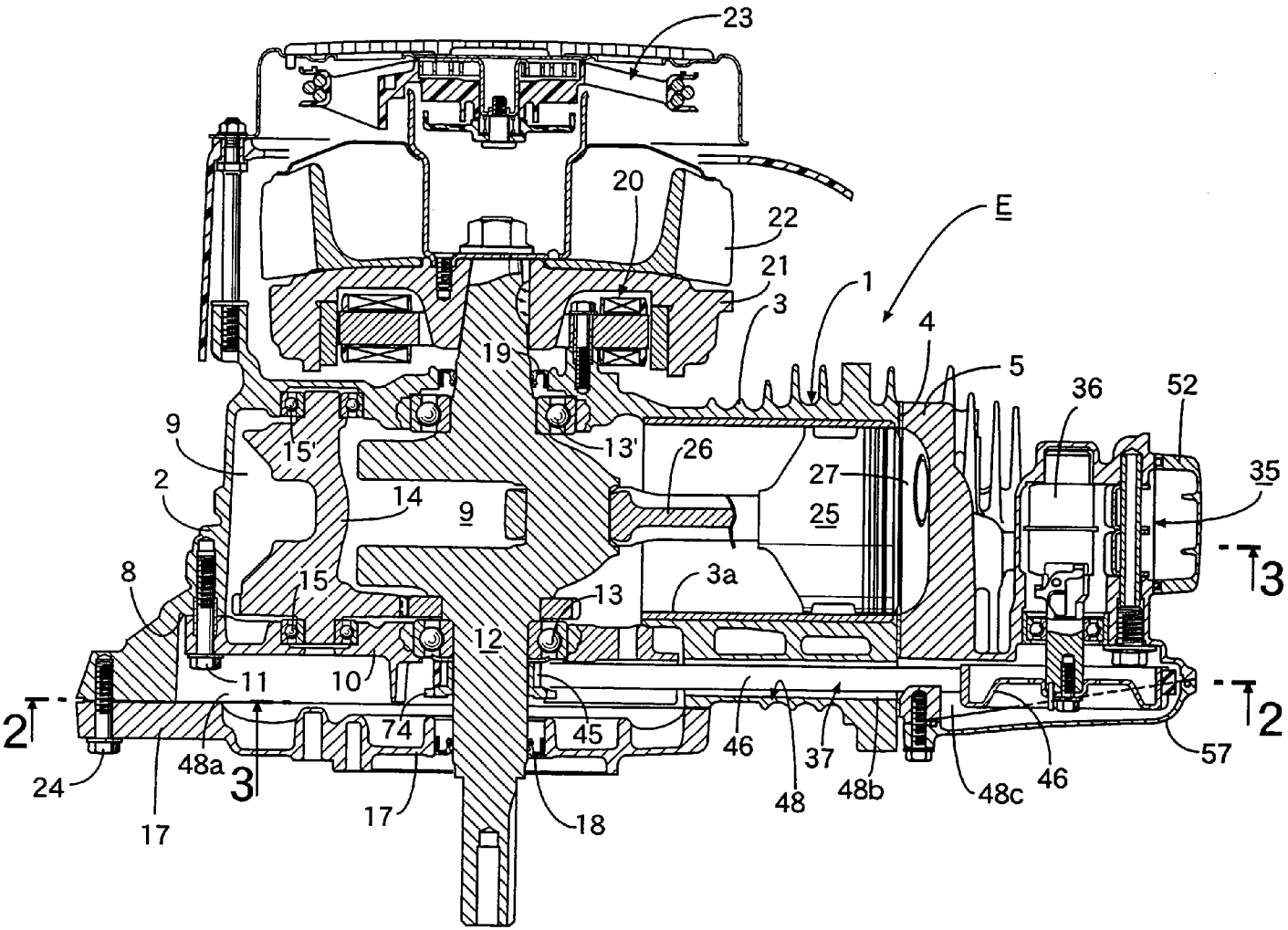
FIG. 1 is a sectional plan view of a general purpose four-cycle engine according to the present invention (first embodiment).
Figure 2:
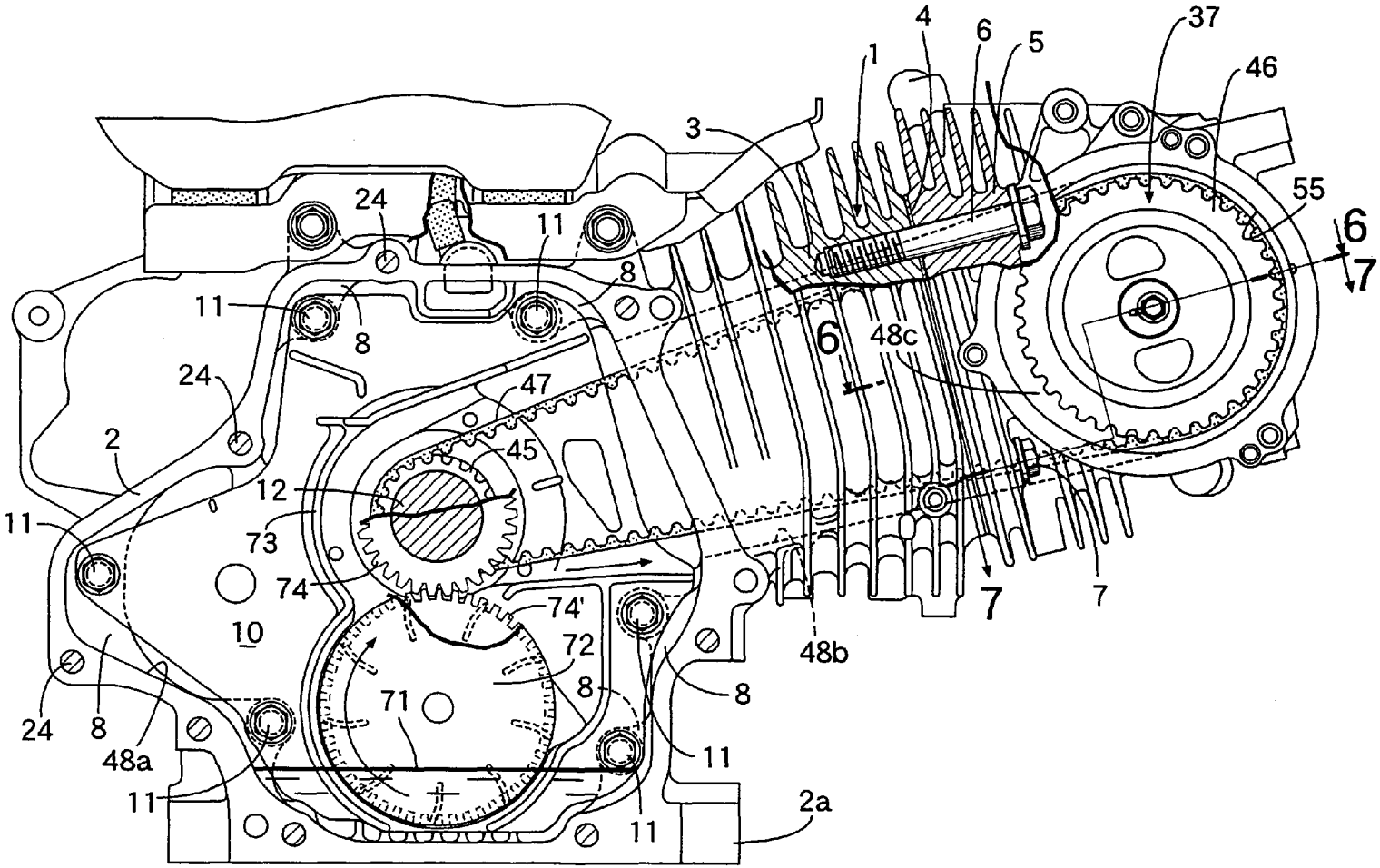
FIG. 2 is a sectional view along line 2-2 in FIG. 1 (first embodiment).

E engine
2 crankcase
3 cylinder block
5 cylinder head
9 crank chamber
12 crankshaft
29*i* intake valve
29*e* exhaust valve
35 valve operating system
36 camshaft
37 timing transmission system
41 bearing (ball bearing)
46 rotationally driven member (driven pulley)
47 endless transmission member (timing belt)
48 timing transmission chamber
49 valve operating chamber
55 access window
57 lid body
64 through hole
71 oil
72 oil slinger
75 oil passage hole
76 oil passage channel
77 oil return hole
79 one-way valve

BEST MODE FOR CARRYING OUT THE INVENTION

Modes for carrying out the present invention are described below by reference to preferred embodiments of the present invention shown in the attached drawings.

Embodiment 1

Referring first to FIG. 1 to FIG. 4, an engine main body 1 of a general purpose four-cycle engine E includes: as components a crankcase 2 having on its lower part a mounting seat 2*a*; a cylinder block 3 connected integrally to the crankcase 2 and having an upwardly inclined cylinder bore 3*a*; and a cylinder head 5 joined to an upper end face of the cylinder block 3 via a gasket 4. Four main connecting bolts 6 disposed at four positions around the cylinder bore 3*a* and two auxiliary connecting bolts 7 and 7, which will be described later, are used and for joining, that is, securing the cylinder head 5 to the cylinder block 3.

The crankcase 2 has one open side face; a plurality of steps 8, 8 are formed integrally on an inner peripheral wall slightly close to the inside relative to the open side face, the steps 8, 8 being arranged in the peripheral direction so as to face toward the open side face, and a bearing bracket 10 is secured to these steps 8, 8 via a plurality of bolts 11, 11. This bearing bracket 10 and another side wall of the crankcase 2 support opposite end parts of a horizontally disposed crankshaft 12 via bearings 13 and 13'. Furthermore, opposite end parts of a balancer shaft 14 disposed adjacent to and in parallel with the crankshaft 12 are similarly supported via bearings 15 and 15 by the bearing bracket 10 and said other side wall of the crankcase 2.

Figure 4:
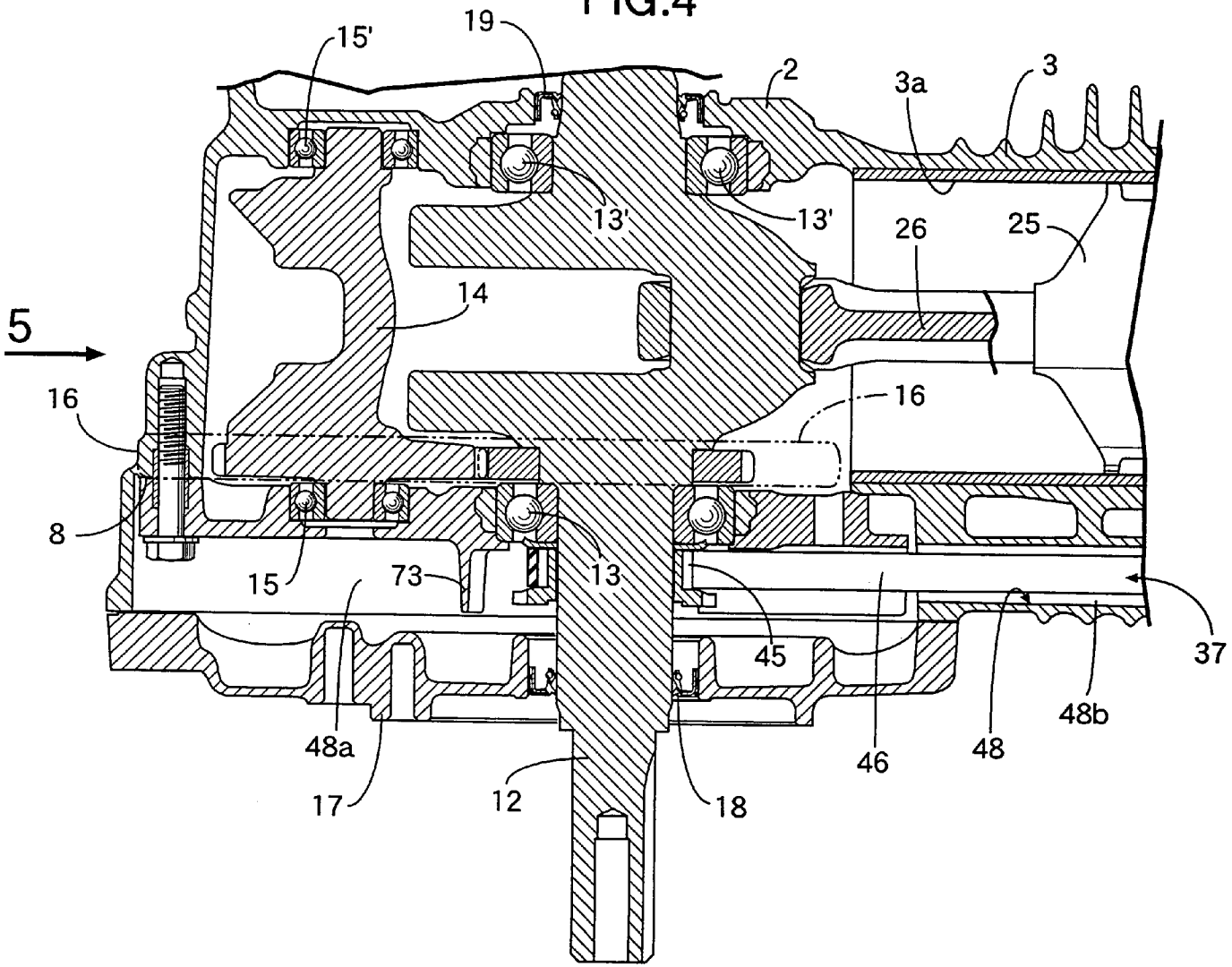
FIG. 4 is an enlarged view of an area around a crankshaft in FIG. 1 (first embodiment).
Figure 5:
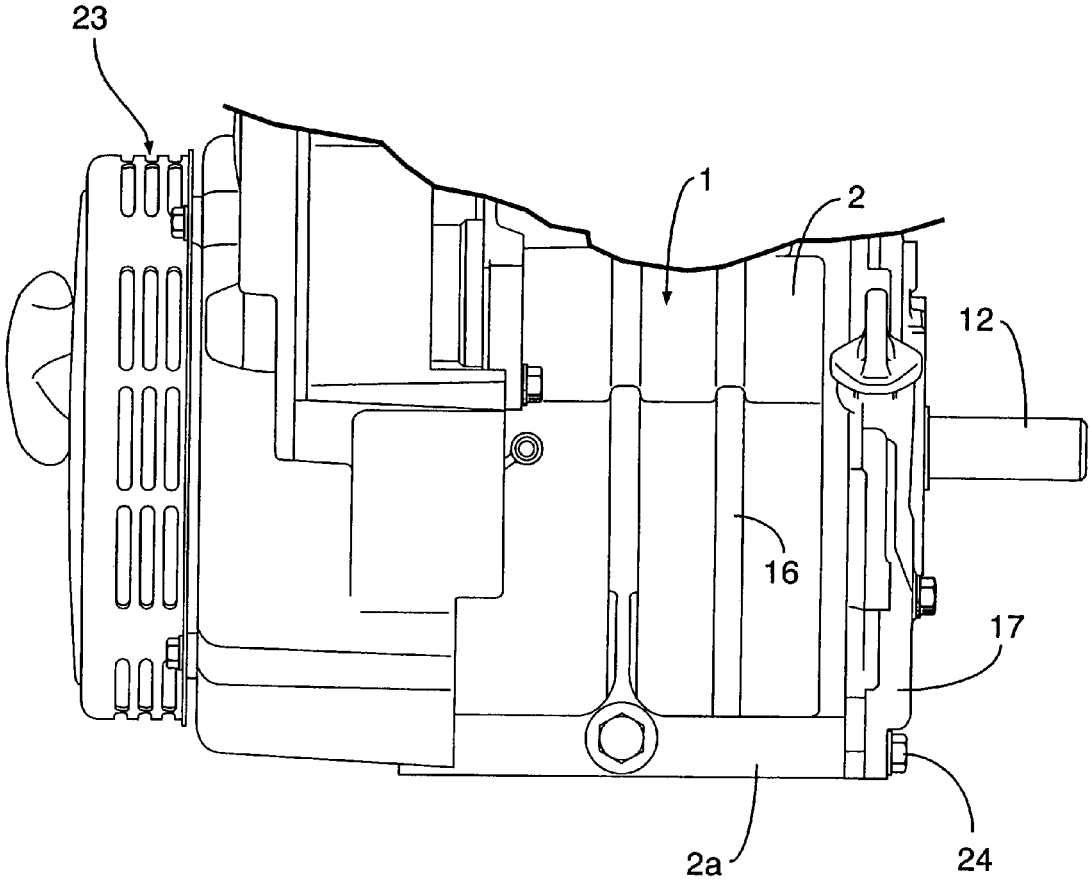
FIG. 5 is a view from arrow 5 in FIG. 4 (first embodiment).

As shown in FIG. 4 and FIG. 5, a continuous reinforcing rib 16 is formed integrally with the outer periphery of the crankcase 2 so as to surround the plurality of steps 8, 8, and an end part of the reinforcing rib 16 is connected integrally to an outside wall of the cylinder block 3, which is integral with the crankcase 2.

Since the reinforcing rib 16 provides, on the outer periphery of the crankcase 2, mutual connection between the plurality of steps 8, 8, which are inside the reinforcing rib 16, the rigidity with which the bearing bracket 10 is supported by these steps 8, 8 and, consequently, the rigidity with which the crankshaft 12 is supported by the bearing bracket 10, can be increased effectively. As a result, the crankcase 2 can be made thin and light. In particular, since an end part of the reinforcing rib 16 is connected integrally to the outside wall of the cylinder block 3, the reinforcing function of the reinforcing rib 16 can be enhanced, thus further increasing the rigidity with which the bearing bracket 10 is supported.

A side cover 17 is joined to the crankcase 2 via a plurality of bolts 24 to close the open face on said one side of the crankcase 2. One end part of the crankshaft 12 runs through the side cover 17 and projects outward as an output shaft part, and an oil seal 18 is mounted on the side cover 17 to be in intimate contact with the outer periphery of the output shaft part.

Referring again to FIG. 1, the other end part of the crankshaft 12 runs through said other side wall of the crankcase 2, and an oil seal 19 is mounted on said other side wall of the crankcase 2 to be in intimate contact with said other end part of the crankshaft 12 so as to be adjacent to the outside of the bearing 13'. A flywheel 21, which also functions as a rotor of a generator 20, is secured to said other end part of the crankshaft 12, and a cooling fan 22 is attached to an outside face of the flywheel 21. Furthermore, a recoil-type starter 23, which is supported on the crankcase 2, is disposed so as to face said other end part of the crankshaft 12.

Figure 3:
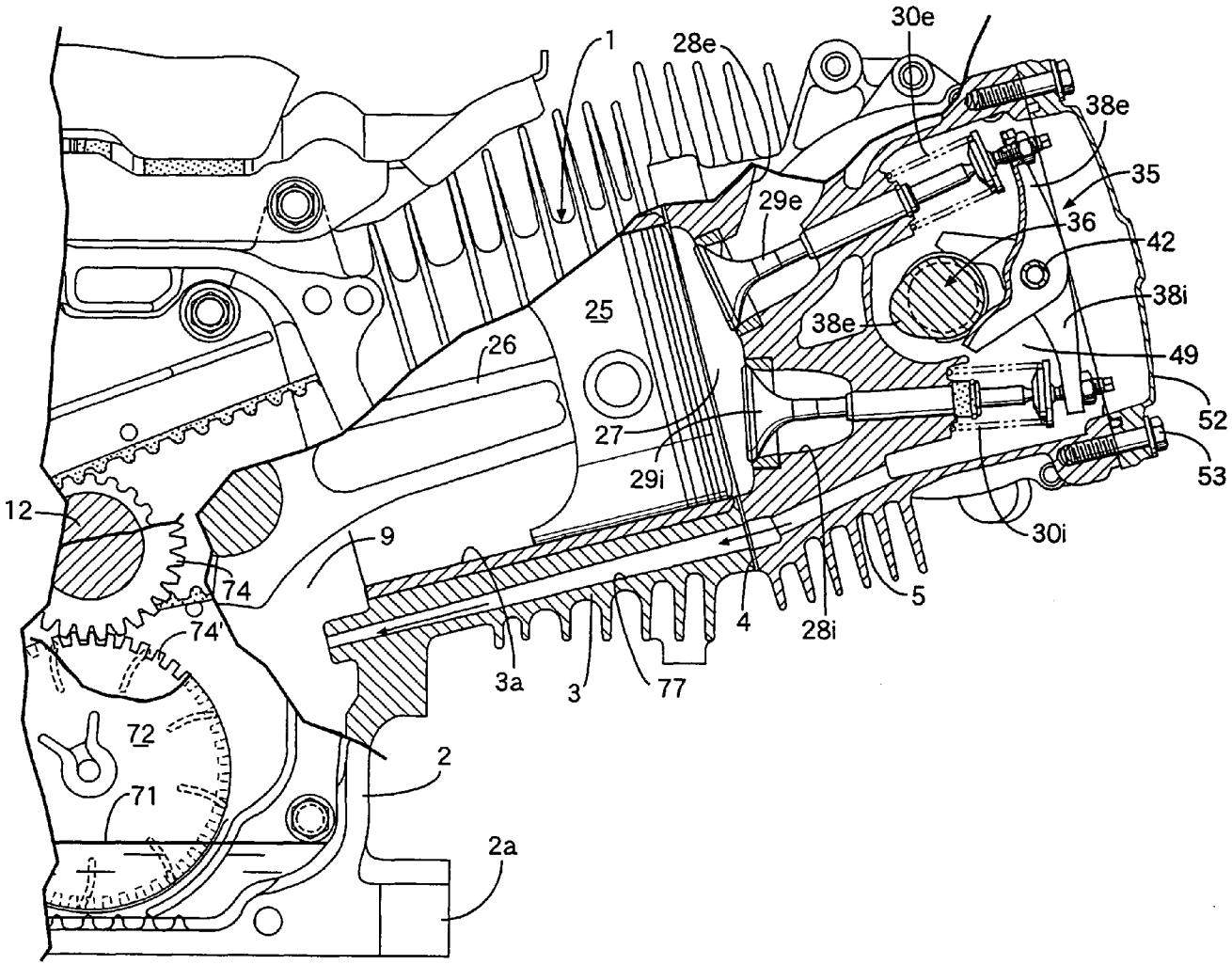
FIG. 3 is a sectional view along line 3-3 in FIG. 1 (first embodiment).

In FIG. 1 and FIG. 3, a piston 25 fitted into the cylinder bore 3*a* is connected to the crankshaft 12 via a connecting rod 26. A combustion chamber 27 communicating with the cylinder bore 3*a*, and an intake port 28*i* and an exhaust port 28*e* each opening in the combustion chamber 27 are formed in the cylinder head 5. An intake valve 29*i* and an exhaust valve 29*e* are mounted in the cylinder head 5 for opening and, closing the ends of the intake and exhaust ports 28*i* and 28*e* respectively that open to the combustion chamber 27. Valve springs 30*i* and 30*e* are fitted onto the intake and exhaust valves 29*i* and 29*e* to urge these valves 29*i* and 29*e* in a direction in which they close. The intake and exhaust valves 29*i* and 29*e* are opened and closed by a valve operating system 35 operating in cooperation with these valve springs 30*i* and 30*e*.

The valve operating system 35 is described by reference to FIG. 3, FIG. 4, and FIG. 6 to FIG. 12.

Figure 6:
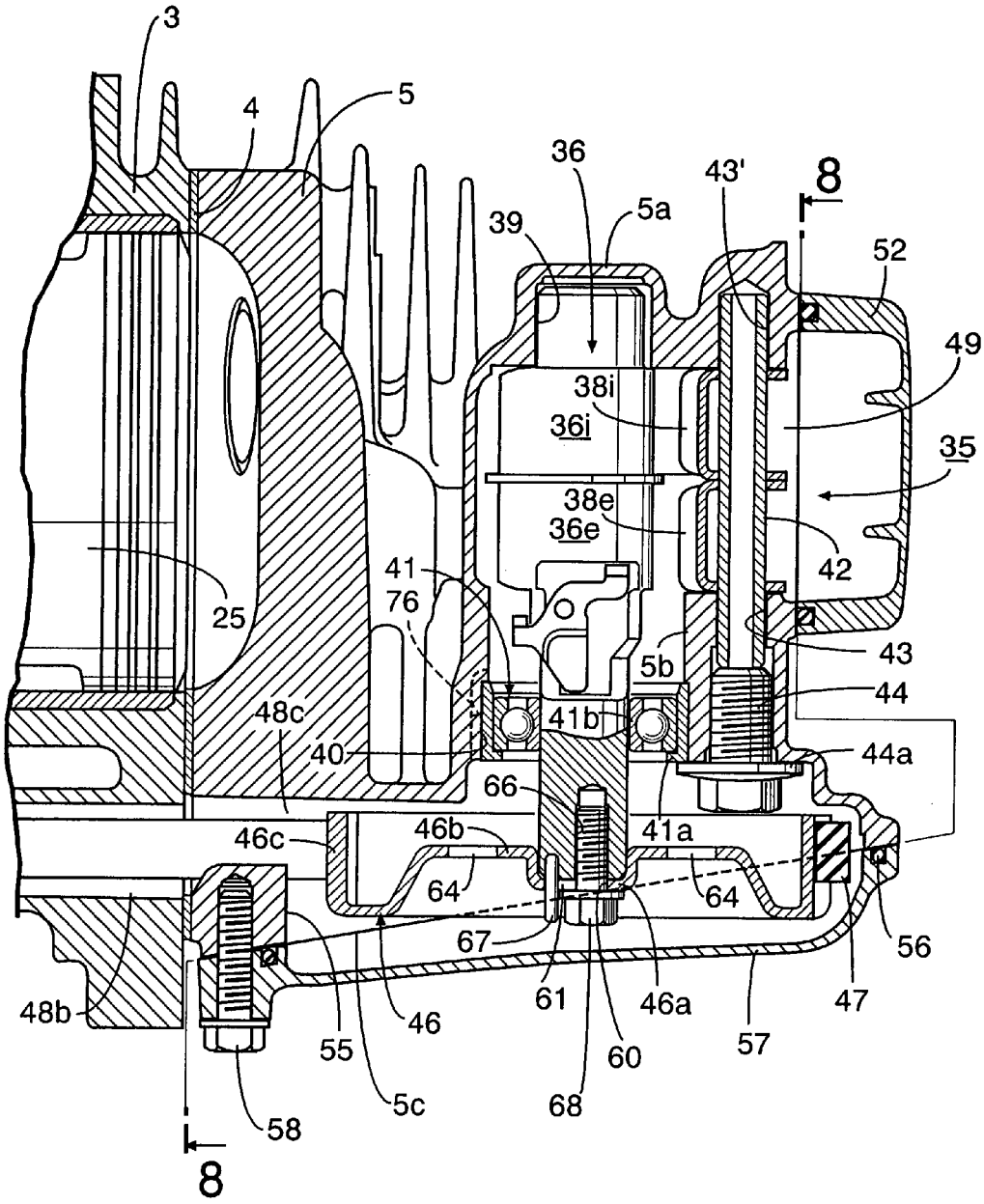
FIG. 6 is a sectional view along line 6-6 in FIG. 2 (first embodiment).

Referring first to FIG. 3, FIG. 4, and FIG. 6, the valve operating system 35 comprises a camshaft 36, a timing transmission system 37, an intake rocker arm 38*i*, and an exhaust rocker arm 38*e*. The camshaft 36 is supported on the cylinder head 5 so as to be parallel to the crankshaft 12, and includes an intake cam 36*i* and an exhaust cam 36*e*. The timing transmission system 37 provides a connection between the crankshaft 12 and the camshaft 36. The intake rocker arm 38*i* provides an operative connection between the intake cam 36*i* and the intake valve 29*i*. The exhaust rocker arm 38*e* provides an operative connection between the exhaust cam 36*e* and the exhaust valve 29*e*.

The camshaft 36 has opposite end parts supported by a pouch-shaped bearing hole 39 and a ball bearing 41, the bearing hole 39 being formed in one side wall 5*a* of the cylinder head 5, and the ball bearing 41 being fitted into a bearing fitting hole 40 of a dividing wall 5*b* in a middle section of the cylinder head 5. One common rocker shaft 42 swingably supporting the intake and exhaust rocker arms 38*i* and 38*e* has opposite end parts supported by first and second support holes 43' and 43 formed in said one side wall 5*a* and the dividing wall 5*b*, respectively. The first support hole 43' of said one side wall 5*a* is pouch-shaped, and the second support 43 of the dividing wall 5*b* is a through hole. A fixing bolt 44 having its extremity abutting against the outer end of the rocker shaft 42 is screwed into the dividing wall 5*b* at an outer end part of the second support hole 43. The rocker shaft 42 is thus prevented from moving in a thrust direction by the pouch-shaped first support hole 43' and the fixing bolt 44.

The fixing bolt 44 has on its head part an integral flange seat 44*a* having a relatively large diameter, the flange seat 44*a* abutting against an outer end face of an outer race 41*a* of the ball bearing 41 supporting the camshaft 36.

An inner race 41*b* of the ball bearing 41 is press-fitted onto the camshaft 36. Thus, when the flange seat 44*a* of the fixing bolt 44 abuts against the outer end of the outer race 41*a* as described above, the camshaft 36 is prevented from moving in a thrust direction by the pouch-shaped bearing hole 39 and the flange seat 44*a*.

Therefore, it is possible to prevent movement in the thrust direction for both the rocker shaft 42 and the camshaft 36 by means of one fixing bolt 44, thus reducing the number of components of the valve operating system 35, simplifying the structure thereof, contributing to making it compact, and contributing to an improvement in the assemblability of the system 35.

The timing transmission system 37 comprises a toothed drive pulley 45 secured to the crankshaft 12, a toothed driven pulley 46 secured to the camshaft 36, and an endless timing belt 47 wound around the drive and driven pulleys 45 and 46, the number of teeth of the driven pulley 46 being twice of that of the drive pulley 45. Rotation of the crankshaft 12 is therefore reduced by ½ by this timing transmission system 37, and transmitted to the camshaft 36. Due to rotation of the camshaft 36, the intake and exhaust cams 36*i* and 36*e* make the intake and exhaust rocker arms 38*i* and 38*e* swing against the urging forces of the valve springs 30*i* and 30*e* respectively, thereby opening and closing the intake and exhaust valves 29*i* and 29*e*.

This timing transmission system 37 is housed in a timing transmission chamber 48 formed by connecting in sequence a lower chamber 48*a*, a middle chamber 48*b*, and an upper chamber 48*c*, the lower chamber 48*a* being defined between the bearing bracket 10 and the side cover 17, the middle chamber 48*b* being formed in the cylinder block 3 on one side of the cylinder bore 3*a*, and the upper chamber 48*c* being formed on one side of the cylinder head 5. That is, the drive pulley 45 is disposed in the lower chamber 48*a*, the driven pulley 46 is disposed in the upper chamber 48*c*, and the timing belt 47 is disposed so as to run through the middle chamber 48*b*. In this way, the space between the bearing bracket 10 and the side cover 17 is utilized effectively for arranging the timing transmission system 37, thereby making the engine E compact.

A valve operating chamber 49 having an open upper face is formed in the cylinder head 5 between said one side wall 5*a* and the dividing wall 5*b*, and the intake and exhaust cams 36*i* and 36*e* of the camshaft 36 and the intake and exhaust rocker arms 38*i* and 38*e*, etc. are housed in the valve operating chamber 49. The open upper face of the valve operating chamber 49 is closed by a head cover 52 joined to the cylinder head 5 via a bolt 53.

The upper chamber 48*c* of the timing transmission chamber 48 and the valve operating chamber 49 communicate with each other via an oil passage hole 75 (see FIG. 8 and FIG. 11) provided in the dividing wall 5*b* and a plurality of oil passage channels 76 (see FIG. 6 and FIG. 11) provided on an inner peripheral face of the bearing fitting hole 40.

In FIG. 6 to FIG. 9, an access window 55 is provided on an outer end face 5*c* of the cylinder head 5, the access window 55 opening the upper chamber 48*c* so that the outer side face of the driven pulley 46 faces the access window 55. The access window 55 is used for inserting the driven pulley 46 within the timing belt 47, and mounting the driven pulley 46 on the camshaft 36. A lid body 57 closing the access window 55 is joined to the outer end face 5*c* via a seal 56 by means of a plurality of bolts 58.

As clearly shown in FIG. 6, the outer end face 5*c* of the cylinder head 5, to which the lid body 57 is joined, comprises an inclined face 5*c* that is inclined so that at least part of the outer periphery of the driven pulley 46 on the side opposite to the drive pulley 45 is exposed through the access window 55, and preferably at least half the periphery of the driven pulley 46 on the side opposite to the drive pulley 45 is exposed through the access window 55.

The structure with which the driven pulley 46 is mounted on the camshaft 36 is now described.

As shown in FIG. 6, the driven pulley 46 comprises a bottomed cylindrical hub 46*a*, a web 46*b* that widens radially from the hub 46*a*, and a toothed rim 46*c* formed on the outer periphery of the web 46*b*. The hub 46*a* is fitted onto the outer periphery of an outer end part of the camshaft 36 projecting toward the upper chamber 48*c* side. An end wall of the hub 46*a* is provided with a bolt hole 60 positioned eccentrically to the center of the hub 46*a*, and a positioning groove 61 extending from one side of the bolt hole 60 to the side exactly opposite to the direction of the eccentricity. Furthermore, a first match mark 62*a* is cut into an outer side face of the rim 46*c*, and a second match mark 62*b* corresponding to the first match mark 62*a* is cut into the outer end face 5*c* of the cylinder head 5. Moreover, the web 46*b* is provided with a plurality of through holes 64, 64 that penetrate it.

Figure 11:
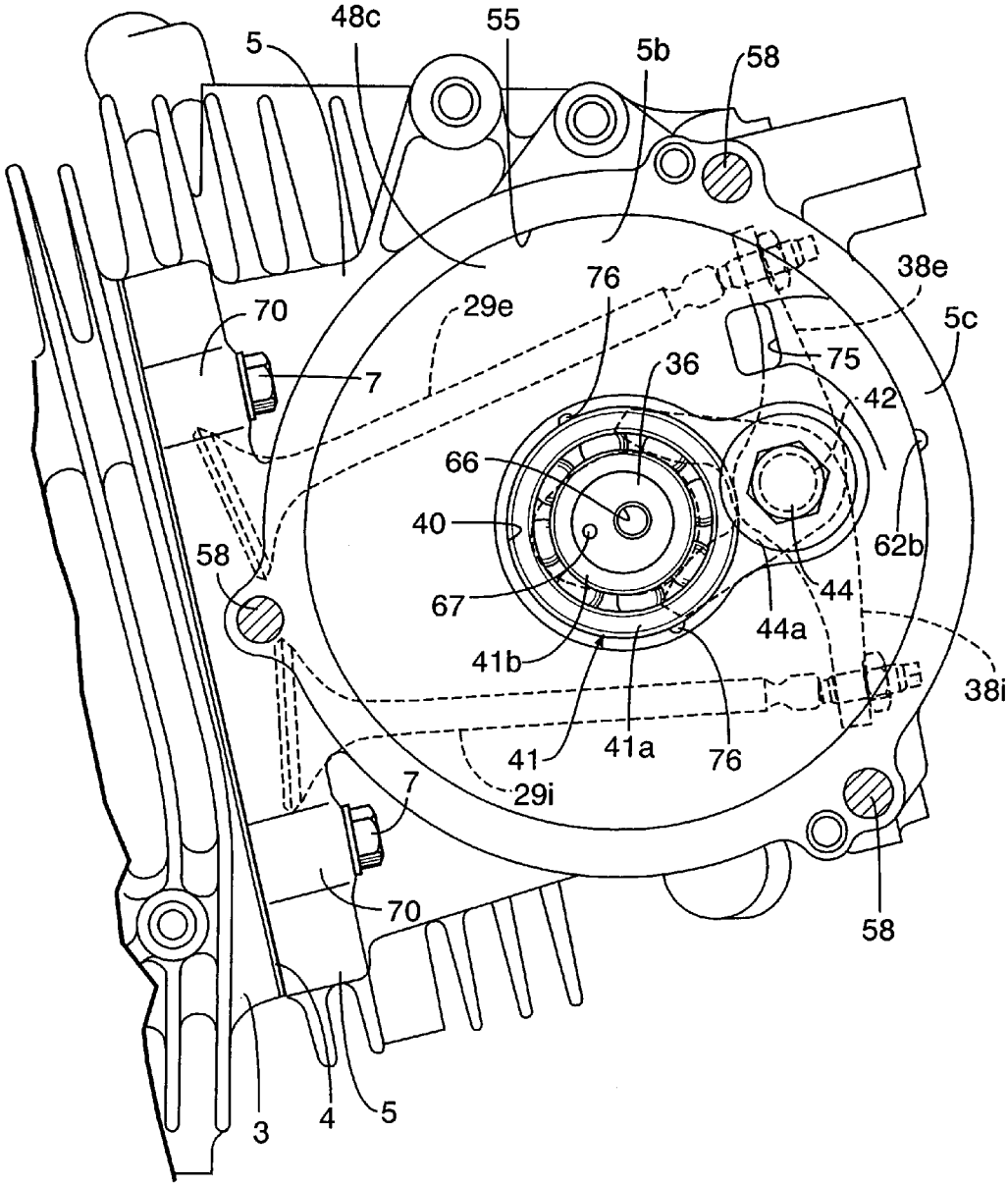
FIG. 11 is a view, corresponding to FIG. 10, in a state in which a driven pulley is removed (first embodiment).
Figure 12:
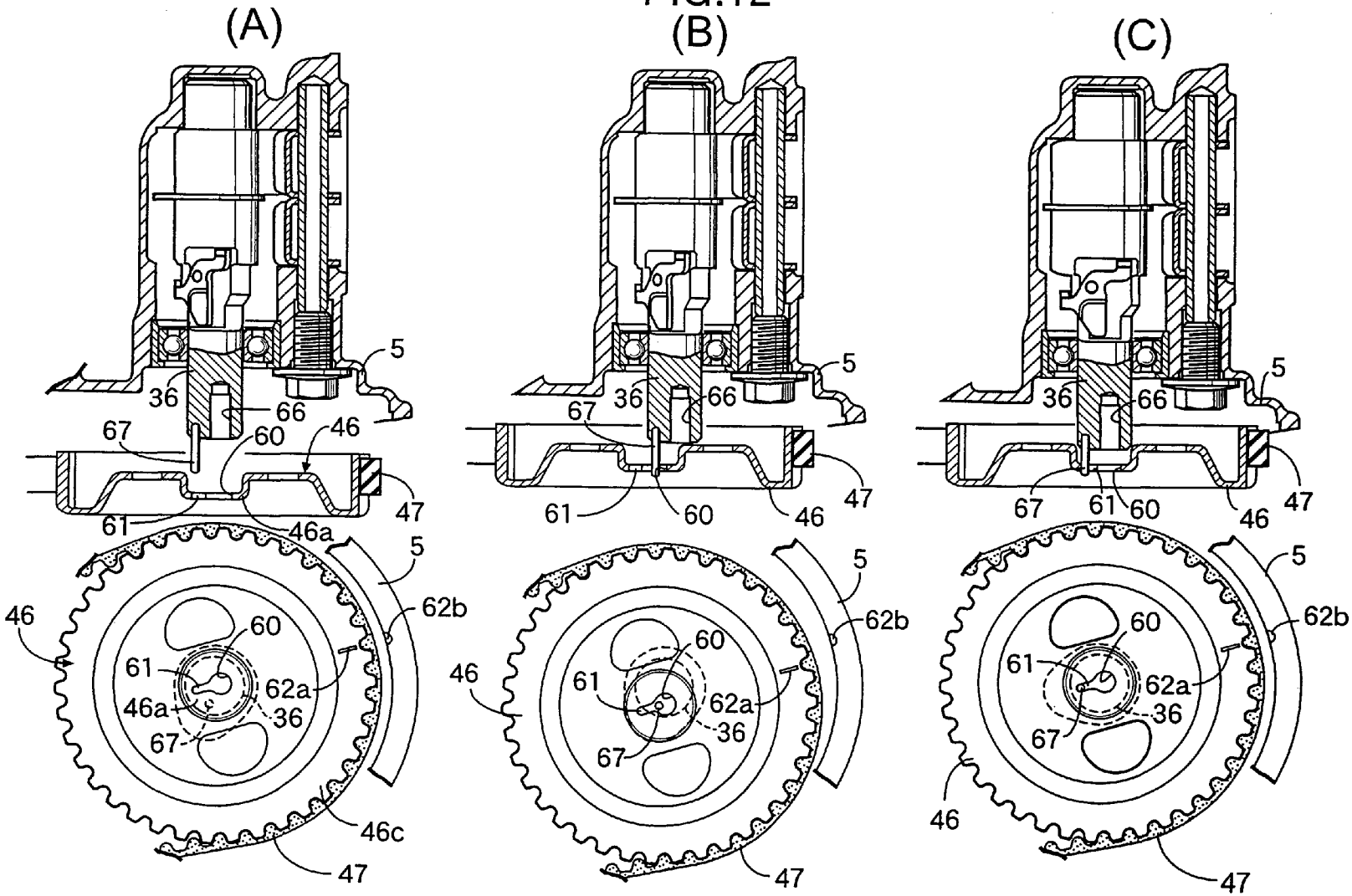
FIG. 12 is a view for describing a procedure of mounting the driven pulley on a camshaft (first embodiment).

The outer end part of the camshaft 36 is provided, as shown in FIG. 6 and FIG. 11, with a threaded hole 66 corresponding to the bolt hole 60 and a positioning pin 67 corresponding to the positioning groove 61.

When the crankshaft 12 is at a predetermined rotational position corresponding to a specified position (for example, top dead center) of the piston 25, and the camshaft 36 is at a position in a predetermined phase relationship with respect to the crankshaft 12, the first match mark 62*a* and the second match mark 62*b*, the bolt hole 60 and the threaded hole 66, and the positioning groove 61 and the positioning pin 67 each coincide with each other on a straight line L running through the centers of the two shafts 12 and 36.

When the driven pulley 46 is mounted on the camshaft 36, the crankshaft 12 is first fixed at the rotational position corresponding to the specified position of the piston 25. Subsequently, as shown in FIG. 12(A), the driven pulley 46 is put inside the timing belt 47, which has been wound around the drive pulley 45 in advance, while making the first match mark 62*a* of the rim 46*c* match the second match mark 62*b* of the cylinder head 5. Next, as shown in FIG. 12(B), when the driven pulley 46 is moved together with the timing belt 47 so that the bolt hole 60 of the driven pulley 46 receives the positioning pin 67 of the camshaft 36 and the positioning pin 67 is then guided into the positioning groove 61, the camshaft 36 rotates in response thereto; and when the positioning pin 67 reaches the extremity of the positioning groove 61, as shown in FIG. 12(C), the bolt hole 60 and the threaded hole 66 match each other at the same time as the camshaft 36 and the hub 46*a* are coaxially aligned.

In this way, by the remarkably simple operation of guiding the positioning pin 67 received by the bolt hole 60 to the positioning groove 61, the first and second match marks 62*a* and 62*b*, the bolt hole 60 and the threaded hole 66, and the positioning groove 61 and the positioning pin 67 are all aligned on the straight line L running through the centers of the crankshaft 12 and the camshaft 36. By visually checking this state, it can easily be confirmed that the crankshaft 12 and the camshaft 36 are in the predetermined phase relationship.

As shown in FIG. 6, screwing and tightening the mounting bolt 68 into the threaded hole 66 through the bolt hole 60 enables the hub 46*a* to be fixed to the camshaft 36. In this way, the timing transmission system 37 is mounted on the crankshaft 12 and the camshaft 36, which are mounted on the crankcase 2 and the cylinder head 5 in advance, in the predetermined phase relationship.

In this case, since the bolt hole 60 and the threaded hole 66 are positioned eccentrically to the centers of the hub 46*a* and the camshaft 36 respectively, rotation of the driven pulley 46 can be transmitted reliably to the camshaft 36 via one eccentric mounting bolt 68, and it is also possible to prevent the mounting bolt 68 from loosening.

Furthermore, since the threaded hole 66 and the positioning pin 67 are positioned eccentrically, in mutually opposite directions, to the center of the camshaft 36, a sufficient degree of eccentricity can be given to each of the bolt hole 60 and the positioning groove 61, which are formed in a narrow end wall of the hub 46*a* of the driven pulley 46, thereby enhancing the positioning effect of the positioning groove 61 relative to the positioning pin and the torque capacity of the mounting bolt 68.

As described above, since the outer end face of the cylinder head 5 on which the access window 55 opens is the inclined face 5*c*, and part of the outer periphery of the driven pulley 46 is exposed through the access window 55, the part of the driven pulley 46 exposed outside the access window 55 can easily be held by a tool, etc. without interference by the cylinder head 5, thereby facilitating the mounting of the driven pulley 46 on the camshaft 36 and the removal thereof. Therefore, this contributes to an improvement in the assemblability and the ease of maintenance.

A side wall 73 of the lid body 57 joined to the outer end face 5*c* of the cylinder head 5, that is, the inclined face 5*c*, is formed so as to be inclined along the inclined face 5*c*. With this arrangement, a head part of the engine main body 1 is shaped such that its lateral width narrows toward the extremity side, thus making the engine E compact.

Figure 7:
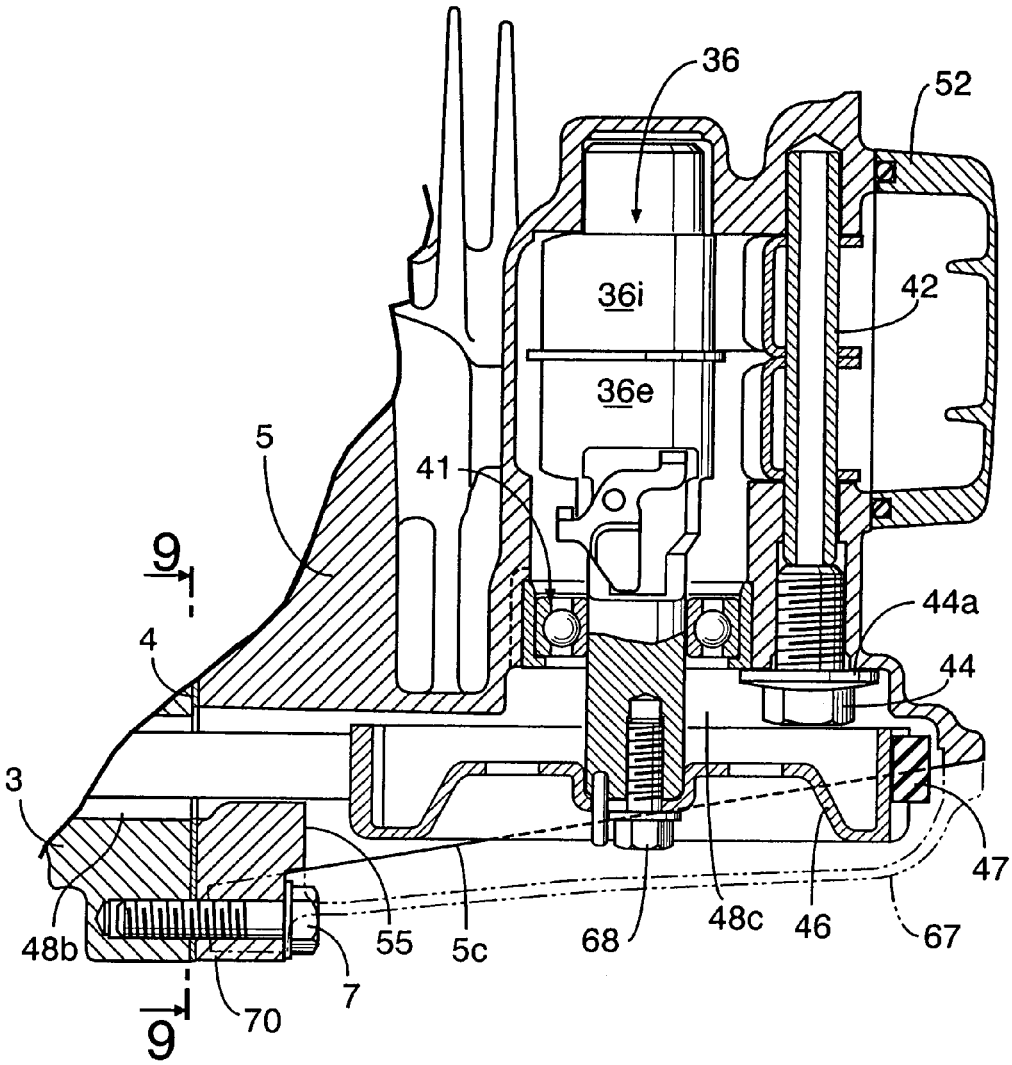
FIG. 7 is a sectional view along line 7-7 in FIG. 2 (first embodiment).
Figure 8:
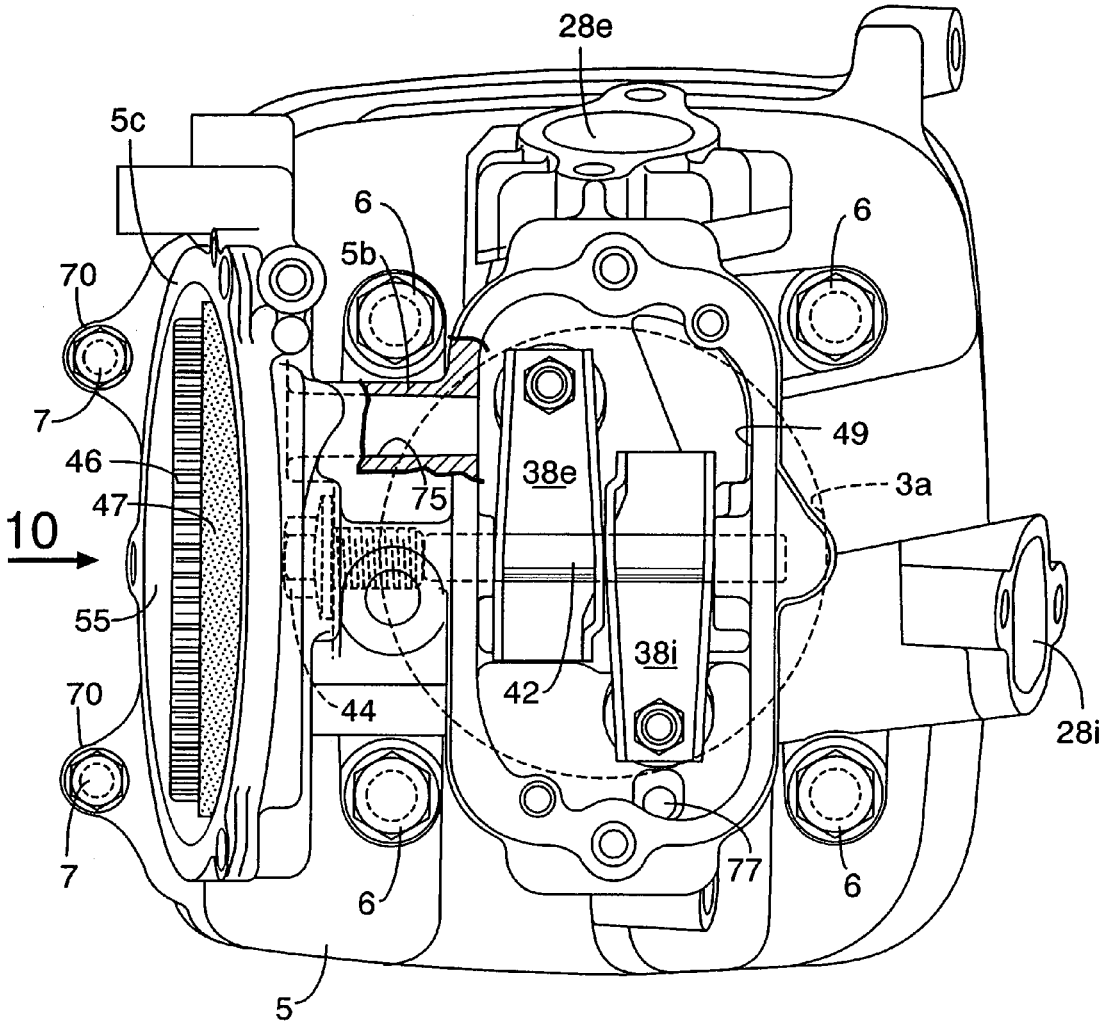
FIG. 8 is a sectional view along line 8-8 in FIG. 6 (first embodiment).
Figure 9:
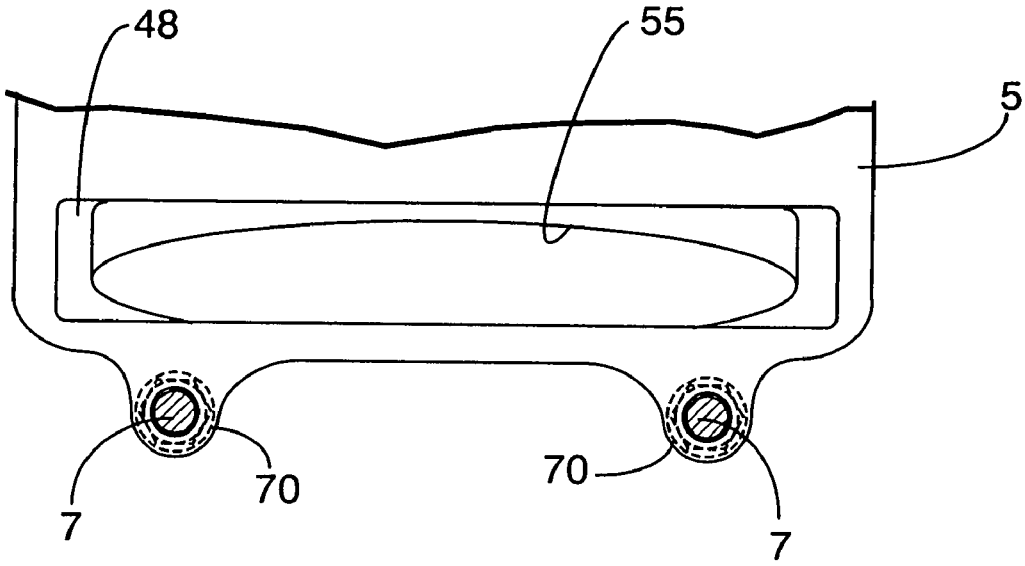
FIG. 9 is a sectional view along line 9-9 in FIG. 7 (first embodiment).
Figure 10:
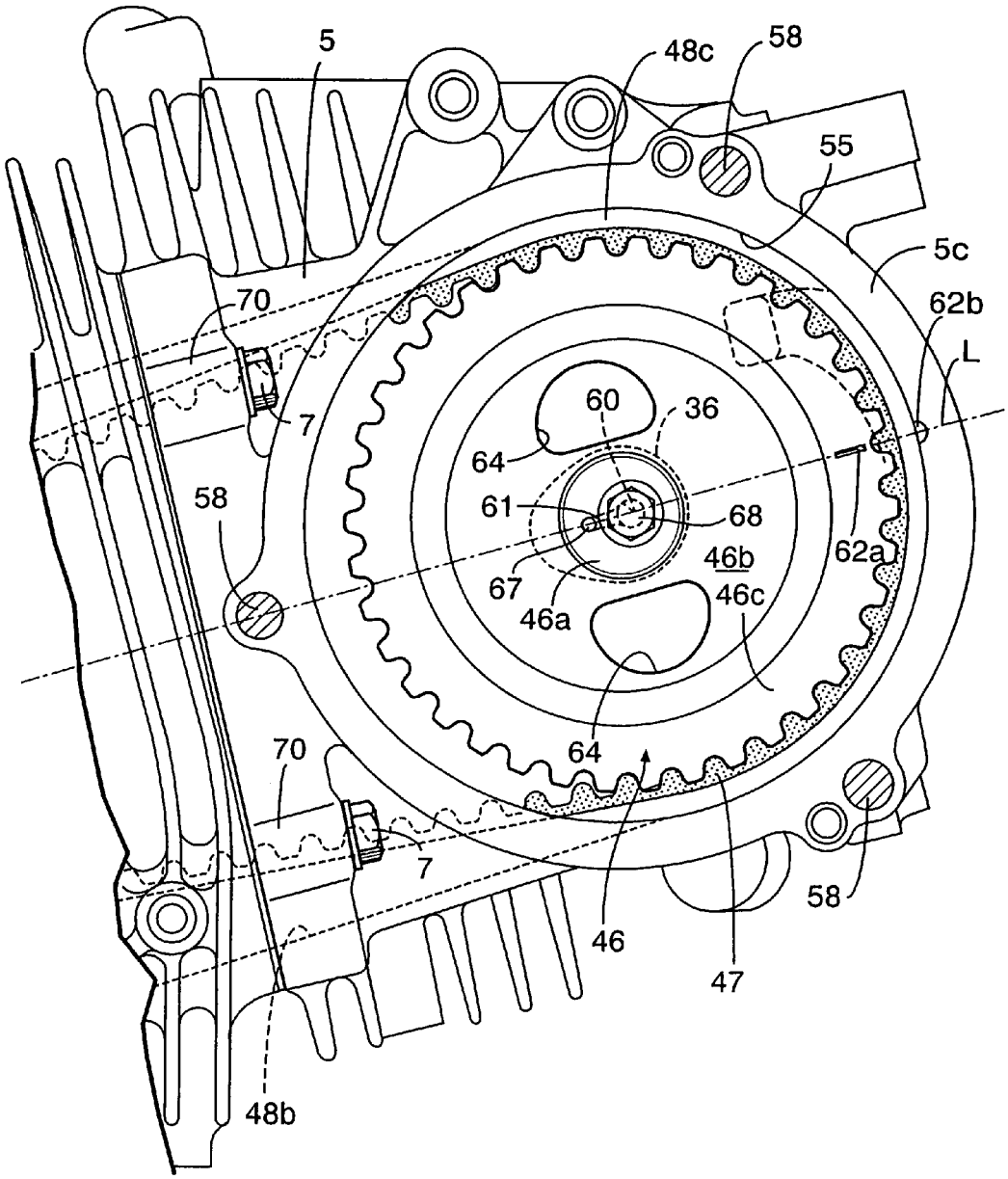
FIG. 10 is a view from arrow 10 in FIG. 8 (first embodiment).

As shown in FIG. 7 to FIG. 9, a pair of projecting parts 70 and 70 projecting outwardly of the access window 55 beneath the access window 55 are formed on the cylinder head 5; these projecting parts 70 and 70 are superimposed on an upper end face, on the outside of the middle chamber 48*b*, of the cylinder block 3 via the gasket 4, and secured to the cylinder block 3 via the auxiliary connecting bolts 7 and 7.

In accordance with such securing by the auxiliary connecting bolts 7 and 7, it is possible to adequately increase the surface pressure acting on the gasket 4 from the cylinder block 3 and the cylinder head 5 even outside the middle chamber 48*b* housing the timing belt 47. Moreover, since the presence of the inclined face 5*c* secures a sufficient space above the auxiliary connecting bolts 7 and 7, for receiving a tool for operating the auxiliary connecting bolts 7 and 7, tightening of the auxiliary connecting bolts 7 and 7 can easily be carried out. This means that the extent to which the projecting parts 70 and 70 project outwardly of the access window 55 can be made small, and this also contributes to making the engine E compact.

Tightening the auxiliary connecting bolts 7 and 7 is carried out prior to the lid body 57 being mounted.

Lubrication of the valve operating system 35 is now described.

In FIG. 1 to FIG. 3, FIG. 6, and FIG. 8, the lower chamber 48*a* of the timing transmission chamber 48 communicates with the interior of the crankcase 2, that is, the crank chamber 9, through the plurality of steps 8, 8 on the inner wall of the crankcase 2 supporting the bearing bracket 10, and a predetermined amount of lubricating oil 71 that is common to the crank chamber 9 and the lower chamber 48*a* accumulates in these chambers.

As shown in FIG. 3, an impeller type oil slinger 72 is disposed in the lower chamber 48*a* so that part of the oil slinger 72 is submerged in the oil 71 that accumulates in the lower chamber 48*a*. The oil slinger 72 is driven by the crankshaft 12 via gears 74 and 74'. This oil slinger 72 scatters the oil 71 around by its rotation, and an oil guide wall 73 for guiding the scattered oil to the timing belt 47 side is formed integrally with an outer side face of the bearing bracket 10 so as to surround the oil slinger 72 and the periphery of the timing belt 47 on the drive pulley 45 side. Since the bearing bracket 10 is a relatively small component, this can easily be cast together with the oil guide wall 73. Further, since the bearing bracket 10 integrally has the oil guide wall 73, its rigidity is strengthened and this is also effective in enhancing the rigidity with which the crankshaft 12 is supported.

In the lower chamber 48*a*, oil scattered by the oil slinger 72 is guided by the oil guide wall 73 to the timing belt 47 side; the oil that has been deposited on the timing belt 47 is transferred to the upper chamber 48*c* by the belt 47; scattered around by being shaken off due to centrifugal force when the timing belt 47 becomes wound around the driven pulley 46; and made to collide with the surrounding wall to thus form an oil mist; and the upper chamber 48*c* is filled with this oil mist, thereby lubricating not only the entire timing transmission system 37 but also the ball bearing 41 of the camshaft 36.

In particular, in the upper chamber 48*c*, when part of the oil shaken off the timing belt 47 collides with the inclined inner face of the lid body 57, it bounces off toward the web 46*b* of the driven pulley 46. This oil passes through the through holes 64 and 64 of the driven pulley 46, and is scattered over the ball bearing 41, thus lubricating the ball bearing 41. Part of the oil scattered over the ball bearing 41 moves to the valve operating chamber 49 through the oil passage channel 76 on the outer periphery of the bearing 41, and the ball bearing 41 is therefore lubricated also from the valve operating chamber 49 side. Lubrication of the ball bearing 41 is thus carried out very well.

As shown in FIG. 3, a base part of the valve operating chamber 49 communicates with the crank chamber 9 via a series of oil return passages 77 formed in the cylinder head 5 and the cylinder block 3 along one side of the cylinder bore 3*a*. The oil return passage 77 is inclined downward toward the crank chamber 9 so that oil flows down from the valve operating chamber 49 to the crank chamber 9.

While the engine E is running, pressure pulsations occur in the crank chamber accompanying the rise and fall of the piston 25, and when the pressure pulsations are transmitted to the valve operating chamber 49 and the timing transmission chamber 48 through the oil return passage 77, the oil passage hole 75 and the oil passage channel 76, oil mist moves to and fro between the valve operating chamber 49 and the timing transmission chamber 48, thereby effectively lubricating the entire valve operating system 35.

After lubrication, oil that has collected in the valve operating chamber 49 flows down the oil return passage 77 and returns to the crank chamber 9. Furthermore, since the base face of the timing transmission chamber 48 is inclined downward toward the lower chamber 48*a*, oil that has collected in the upper chamber 48*c* flows down the middle chamber 48*b* and returns to the lower chamber 48*a*.

In this way, by utilizing the operation of the oil slinger 72 and the timing transmission system 37 and the pressure pulsations of the crank chamber 9, the interiors of the timing transmission chamber 48 and the valve operating chamber 49, which are separated from each other, can be lubricated with oil mist. Therefore, it is unnecessary to employ an oil pump exclusively used for lubrication, whereby structure of the engine E can be simplified and made compact, and the cost can be reduced. Further, it is possible to maintain the arrangement in which the camshaft 36 is disposed above the intake and exhaust valves 29*i* and 29*e*, thereby ensuring a desired output performance for the engine.

Embodiment 2

Figure 13:
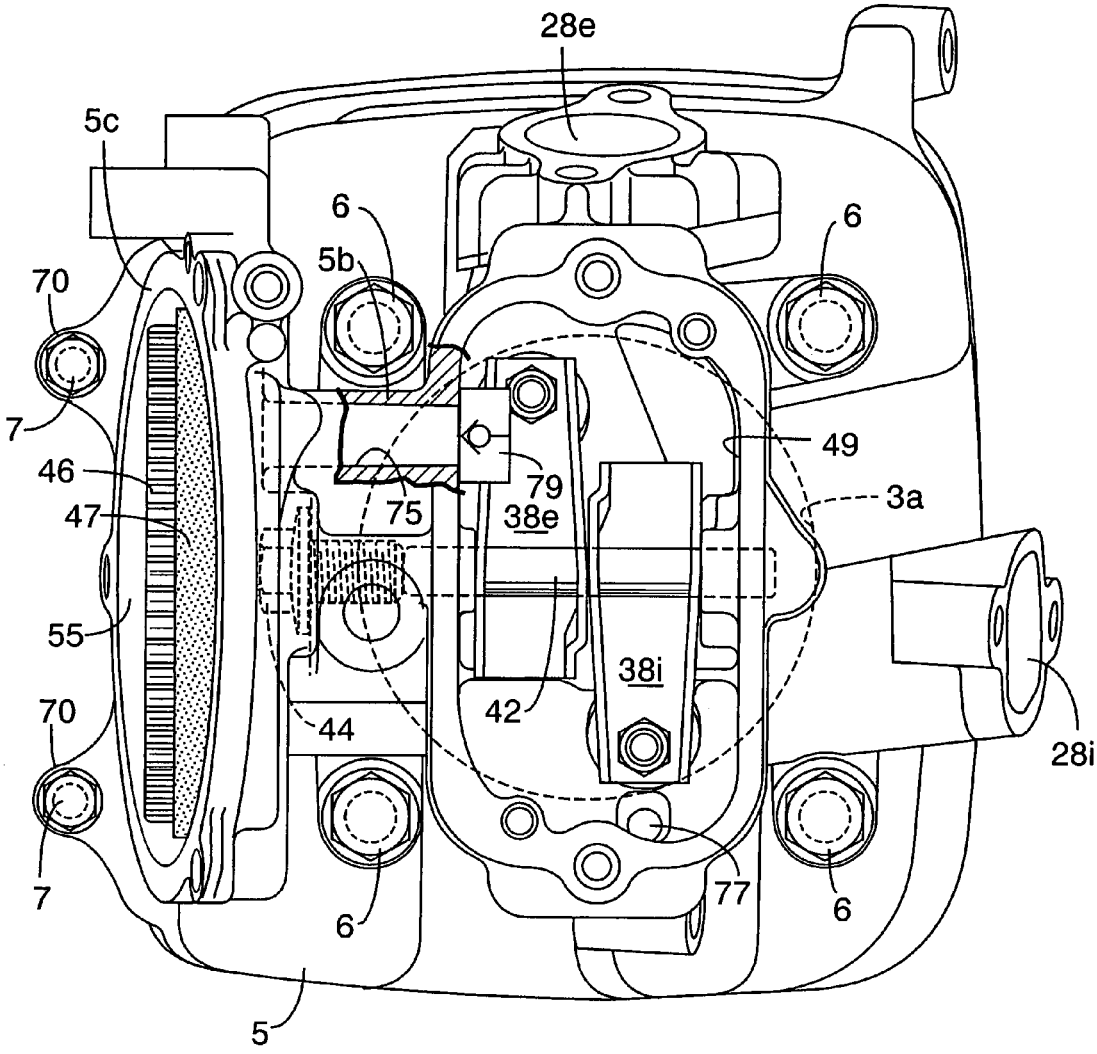
FIG. 13 is a view, corresponding to FIG. 8, showing another embodiment of the present invention (second embodiment).

Another embodiment of the present invention shown in FIG. 13 is now explained.

In this embodiment, a one-way valve 79 is provided in the oil passage hole 75 that provides communication between the timing transmission chamber 48 and the valve operating chamber 49. The one-way valve 79 allows only negative pressure to be transmitted from the valve operating chamber 49 to the timing transmission chamber 48. Since the other components are the same as those of the preceding embodiment, parts in FIG. 13 corresponding to those of the preceding embodiment are denoted by the same reference numerals and symbols, and explanation thereof is omitted.

In this embodiment, when the pressure pulsations generated in the crank chamber 9 reach the valve operating chamber 49, only the negative pressure thereof passes through the one-way valve 79 and acts on the timing transmission chamber 48. Therefore, oil mist in the timing transmission chamber 48 can be drawn efficiently into the valve operating chamber 49 by virtue of the action of the negative pressure, thus enhancing the lubrication within the valve operating chamber 49.

The present invention is not limited to the above-mentioned embodiments, and may be modified in a variety of ways as long as the modifications do not depart from the spirit and scope thereof. For example, the belt type timing transmission system 37 may be replaced with a chain type.

The invention claimed is:

1. An engine valve operating system in which a timing transmission chamber (48) is formed on one side of an engine main body (1) formed from a crankcase (2), a cylinder block (3), and a cylinder head (5); the timing transmission chamber (48) houses a timing transmission system (37) that provides a connection between a crankshaft (12) supported on the crankcase (2) and a camshaft (36) supported on the cylinder head (5) above intake and exhaust valves (29*i*, 29*e*); opposite end parts of the camshaft (36) are supported by one side wall (5*a*) of the cylinder head (5) and a dividing wall (5*b*) formed in the cylinder head (5) so as to be adjacent to the timing transmission chamber (48); and a valve operating chamber (49) housing the camshaft (36) is defined between said one side wall (5*a*) and the dividing wall (5*b*), characterized in that an oil slinger (72) is disposed in the timing transmission chamber (48), the oil slinger (72) scattering lubricating oil (71) that has accumulated in a base part of the timing transmission chamber (48) to deposit the lubricating oil (71) on a lower part of the timing transmission system (37); an oil passage hole (75) is provided in the dividing wall (5*b*), the oil passage hole (75) guiding scattered oil that has been shaken off in an upper part of the timing transmission system (37) to the valve operating chamber (49); and an oil return passage (77) is provided in the cylinder head (5) and the cylinder block (3), the oil return passage (77) transmitting pressure pulsations generated in the crank chamber (9) within the crankcase (2) to the valve operating chamber (49) and making oil that has collected in the valve operating chamber (49) flow downward to the crank chamber (9).

2. The engine valve operating system according to claim 1, wherein an access window (55) opens on another side face of the cylinder head (5), the access window (55) enabling a rotationally driven member (46) of the timing transmission system (37) to be mounted on and demounted from the camshaft (36); a side wall of a lid body (57) closing the access window (55) is inclined relative to a side face of the rotationally driven member (46) so that scattered oil shaken off in the upper part of the timing transmission system (37) bounces back on an inner face of the side wall of the lid body (57) toward the rotationally driven member (46) side; and a through hole (64) allowing the bounced-back oil to pass therethrough is provided in the rotationally driven member (46).

3. The engine valve operating system according to claim 2, wherein an oil passage channel (76) is provided in the dividing wall (5*b*), the oil passage channel (76) providing communication between the timing transmission chamber (48) and the valve operating chamber (49) and around a bearing (41) of the camshaft (36).

4. The engine valve operating system according to either one of claims 1 to 3, wherein a one-way valve (79) is provided in the oil passage hole (75), the one-way valve (79) allowing only negative pressure to be transmitted from the valve operating chamber (49) to the timing transmission chamber (48).

* * * * *